United States Patent [19]

Cole

[11] 4,176,868

[45] Dec. 4, 1979

[54] SECURITY GATE POST

[76] Inventor: George A. Cole, 4529 Royal Oak Dr. SW., Roanoke, Va. 24015

[21] Appl. No.: 905,288

[22] Filed: May 11, 1978

[51] Int. Cl.[2] ..... E05C 3/04

[52] U.S. Cl. ..... 292/258; 292/54

[58] Field of Search ..... 292/31, 54, 246, 258, 292/288, 44, 24; 70/19, 61, 371

[56] References Cited

U.S. PATENT DOCUMENTS

| | | | |
|---|---|---|---|
| 1,411,824 | 4/1922 | Wepplo | 292/258 |
| 1,956,438 | 4/1934 | Eichenauer | 70/371 X |
| 2,169,846 | 8/1939 | Moores | 292/31 |
| 2,458,002 | 1/1949 | Kaskouras | 292/DIG. 2 |

*Primary Examiner*—Richard E. Moore

[57] ABSTRACT

A clamping mechanism for receiving the free end of a swinging gate or the like including a pair of pivoted, clam-like arms, carried by a pedestal capable of being mounted upon a hollow cylindrical support via an expandible sleeve forming a part of the pedestal, the aforesaid arms being U-shaped in cross section with the open sides facing in such a manner that when closed only an opening formed by their ends is accessible to admit the aforementioned gate end. A locking mechanism is provided internal of the arms.

4 Claims, 2 Drawing Figures

SECURITY GATE POST

BACKGROUND OF THE INVENTION

Frequently security of surroundings is required by closing off private roads and the like to prevent access to unauthorized parties, and the erection of complex barriers is undesirable. The present invention provides a simple and inexpensive, but nevertheless effective, for providing such security merely by placing single posts on either side of a road or highway to be protected and making use of commercially available steel pipes both for the aforesaid posts and the gate structure per se. In the subject appliation an invention is described relating to a security post for locking a gate structure provided from a rotating security hinge device as set forth in copending application Ser. No. 905,289 filed May 11, 1978.

SUMMARY OF THE INVENTION

This invention, therefore, is directed to a structure suitable for attachment to an upright steel post and including a clam shell, pivotted mechanism, which when in its opened position will admit the introduction of the free end of a swinging, cantilever type gate. The gate may consist of nothing more than a heavy steel pipe. However, when the mechanism is closed not only is the end of the gate seized securely, but also the internal locking structure is covered and made fail safe automatically.

IN THE DRAWINGS

DETAILED DESCRIPTION OF THE INVENTION

Figure 1:
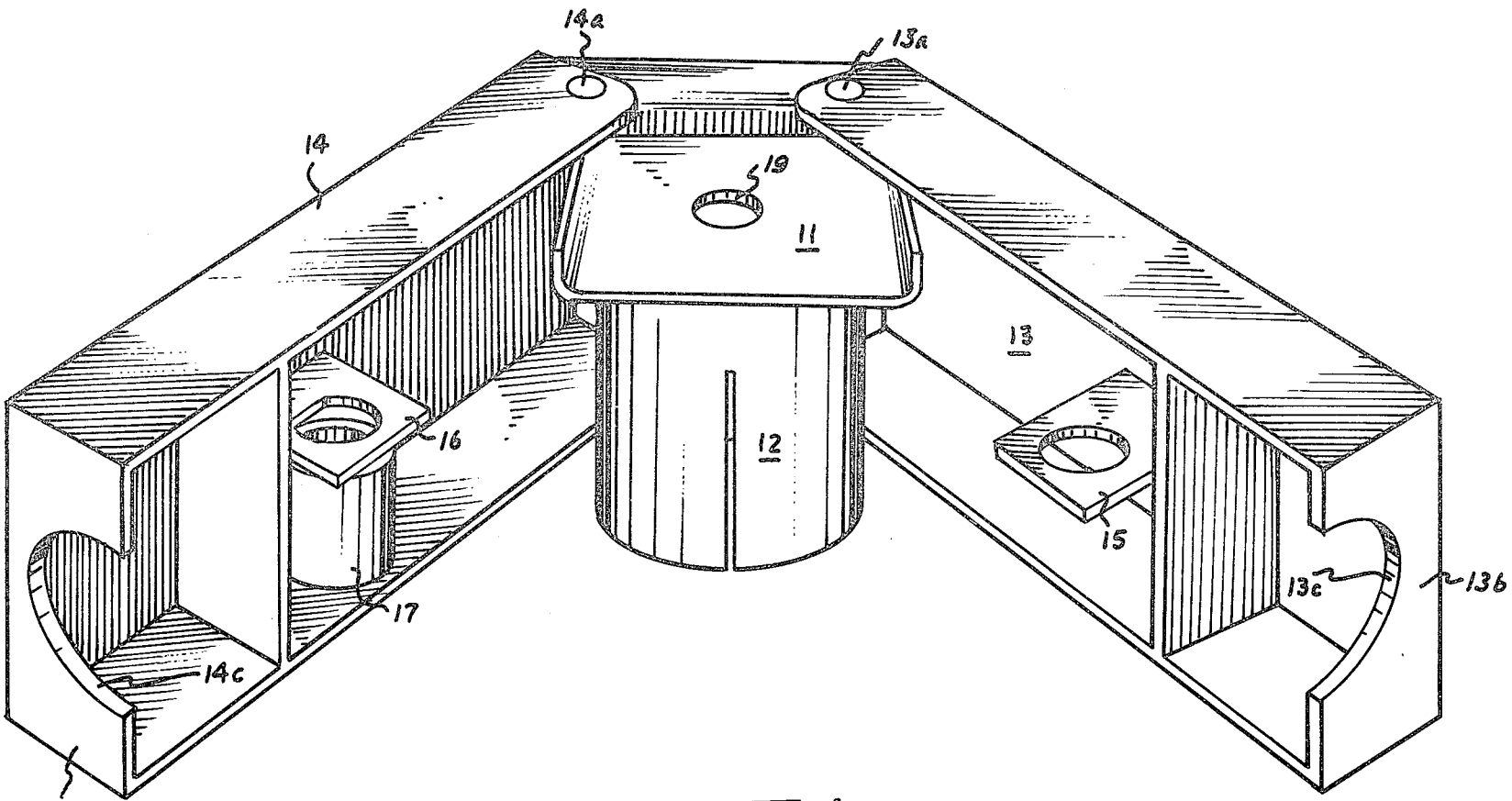
FIG. 1 is a perspective view of the gate mechanism showing the pivotted arms and their construction and fixed mounting.

Reference is made to FIG. 1 of the drawings wherein a pedestal 11 welded to a split tube 12 carries a pair of arms 13 and 14 pivotally connected to the pedestal at 13*a* and 14*a*. The arms 13 and 14 are similar in construction, being of welded, box-like shape and arranged in their closed position (See FIG. 2) to completely enclose the pedestal and the top part of the tube 12. The arms 13 and 14 are open on their inner sides (as indicated in FIG. 1) and the arm 13 includes a staple ring 15 internally welded therein. A similar staple ring 16 is welded to the inside of arm 14 which also has a hollow sleeve 17 attached in a similar manner. The staples or rings 15 and 16, together with the opening of the sleeve 17 permit the entry of an expansion type cylinder lock from the under side of arm 14 when the arms 13 and 14 are closed, thereby providing a convenient means of locking the structure securely.

Figure 2:
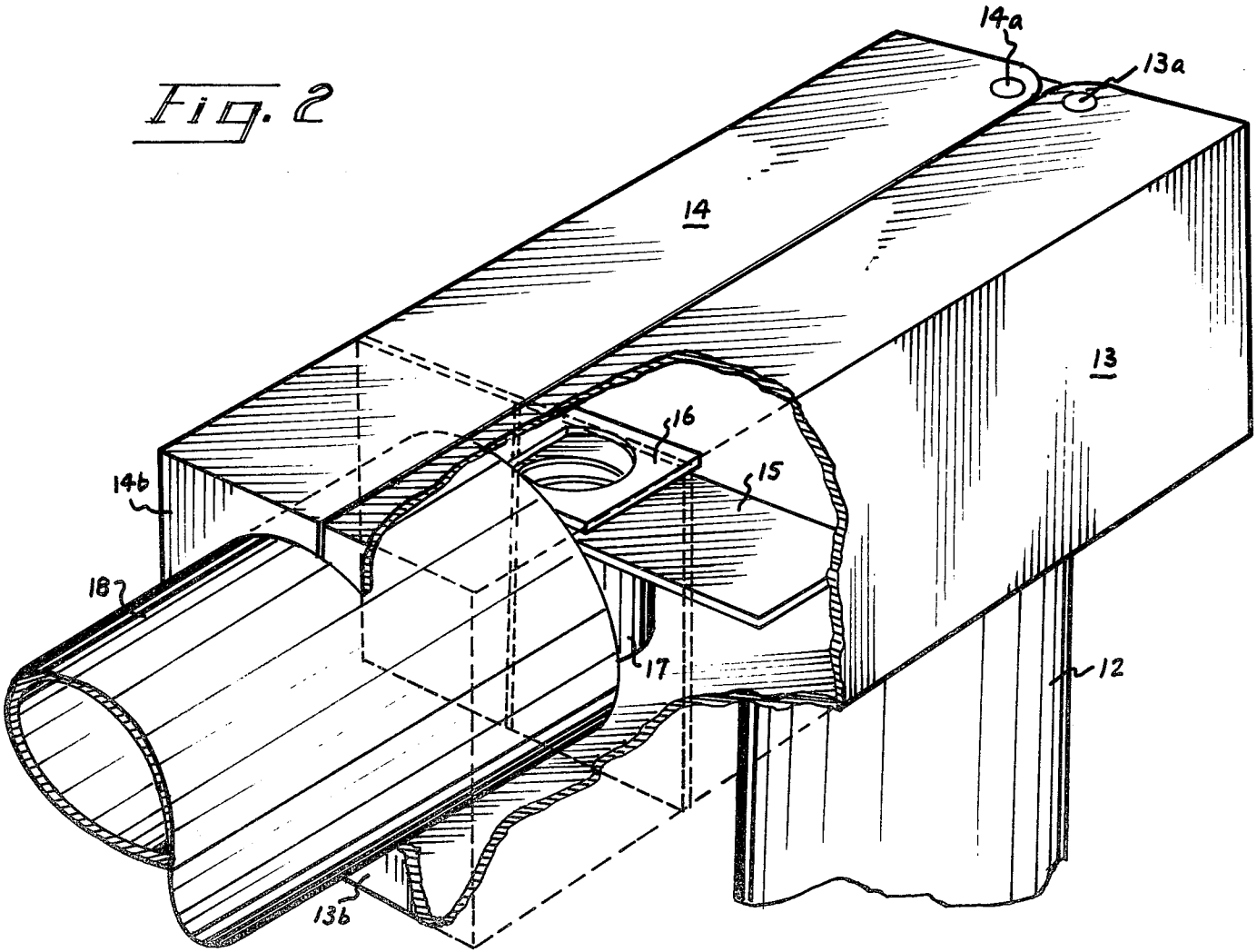
FIG. 2 is a perspective/sectional view of the invention as applied to the securing of a swinging gate as previously mentioned above.

The ends of the arms 13 and 14 are closed by pieces 13*b* and 14*b;* however, these pieces have cut outs 13*c* and 14*c* which form a means for embracing the end of a swinging gate 18, such as may be formed by a single length of steel pipe as shown in FIG. 2.

When necessary in order to further insure the security of the pedestal 11 being secured to the tube 12 an expansion bolt may be inserted through the tube 12 which is inserted into a steel post of larger diameter and the two members fastened together via the opening 19 in the pedestal 11.

What is claimed is:

1. A security device for detachably fastening the free end of a cantilever member rigidly to an upright post comprising a pedestal attached to the top of said post, a pair of U-shaped arms pivotally mounted at their ends on said pedestal, the open sides of said arms facing each other in clam-shell fashion, a closure in the free end of each said arm, and an opening in each said closure, said openings together encompassing the end of said member to connect it to said post when said arms are closed together.

2. The invention of claim 1 wherein said arms are arranged when closed to isolate all access to said pedestal.

3. The invention of claim 1 with the further provision of a pair of locking staples, one mounted internally of each said arm and coacting in movement therewith to coincide mechanically when said arms are closed together.

4. The invention of claim 3 with the further provision of an opening in one said arm for inserting a lock into said staples.

* * * * *